United States Patent [19]

Riley et al.

[11] Patent Number: 4,519,662

[45] Date of Patent: May 28, 1985

[54] HIGH PRESSURE ELECTRICAL PENETRATOR

[75] Inventors: Robert F. Riley, Ellicott City; Thomas I. Meyer, Severna Park; Wesley N. Jordan, Annapolis, all of Md.

[73] Assignee: Westinghouse Electric Corp., Pittsburgh, Pa.

[21] Appl. No.: 366,456

[22] Filed: Apr. 8, 1982

[51] Int. Cl.[3] ..... H01R 4/00

[52] U.S. Cl. ..... 339/94 R; 339/126 R; 339/275 R

[58] Field of Search ..... 339/94, 126, 218, 167, 339/275 R, 275 B, 275 C, 103, 105, 278 D; 174/152, 153

[56] References Cited

U.S. PATENT DOCUMENTS

| | | | |
|---|---|---|---|
| 2,255,184 | 9/1941 | Osenberg | 339/218 R |
| 2,499,474 | 3/1950 | Engqvist | 339/167 |
| 2,552,686 | 5/1951 | Melcher | 174/153 R |
| 2,758,292 | 8/1956 | Berg | 339/126 R |
| 2,911,460 | 11/1959 | Oxley . | |
| 2,995,617 | 8/1961 | Maximoff et al. . | |
| 3,095,470 | 6/1963 | Dozier . | |
| 3,148,011 | 9/1964 | Brown | 339/218 R |
| 3,202,757 | 8/1965 | Carlson et al. . | |
| 3,290,639 | 12/1966 | Driemeyer . | |
| 3,339,014 | 8/1967 | Oxley . | |
| 3,495,028 | 2/1970 | Tutthill . | |
| 3,721,943 | 3/1973 | Curr . | |
| 3,998,515 | 2/1976 | Panek . | |
| 4,003,620 | 1/1977 | O'Brien et al. . | |
| 4,062,612 | 12/1977 | Evans . | |
| 4,117,254 | 9/1978 | Richter | 174/153 R |
| 4,174,145 | 11/1979 | Oeschger et al. . | |
| 4,252,394 | 2/1981 | Miller . | |
| 4,259,546 | 3/1981 | Conway . | |

FOREIGN PATENT DOCUMENTS

| | | |
|---|---|---|
| 770307 | 3/1957 | United Kingdom . |
| 921893 | 3/1963 | United Kingdom . |
| 988775 | 4/1965 | United Kingdom . |

*Primary Examiner*—Joseph H. McGlynn
*Assistant Examiner*—David L. Pirlot
*Attorney, Agent, or Firm*—D. Schron

[57] ABSTRACT

An electrical penetrator for use in high pressure situations includes a metallic penetrator body having a central aperture therein which includes a conical portion and a cylindrical portion. An electrically conducting pin member fits within the aperture and has a cone portion which fits within and is displaced from the conical surface portion. An encapsulating compound maintains the pin in its proper orientation displaced from the interior walls of the aperture with the compound including a polyamide cured epoxy resin mixed with silica.

8 Claims, 4 Drawing Figures

HIGH PRESSURE ELECTRICAL PENETRATOR

BACKGROUND OF THE INVENTION

1. Field of the Invention

The invention relates to the general field of electrical penetrators, and particularly to one utilized in a high differential pressure environment.

2. Description of the Prior Art

Electrical penetrators are utilized for making electrical connection from one side of a bulkhead to another. The bulkhead may represent a panel, a wall or an enclosed vessel, by way of example.

A typical electrical penetrator includes a penetrator body having a central aperture with an electrically conducting pin member centrally maintained within the aperture by means of some sort of a potting or encapsulating material. Some encapsulating materials such as rubber are relatively soft so as to maintain an hermetic seal between opposite sides of the bulkhead. Other encapsulating materials include the use of relatively hard epoxy resins and in many instances, the electrically conducting pin member includes one or more grooves so as to present a better gripping surface for the epoxy.

When utilized in an environment wherein a differential pressure exists across the bulkhead, the rubber encapsulating material has a tendency to extrude, eventually resulting in the loss of the hermetic seal. The epoxy encapsulating material is sufficient for some differential pressures, however, if the differential pressure is extreme, such as may be experienced at great ocean depths, the axial force on the central pin member is translated to a shear force on the encapsulating material which is relatively weak in shear, and the arrangement is subject to loss of hermetic seal and even possible loss of the pin.

The present arrangement provides for a pin structure which can be utilized in extremely high differential pressure environments and which will maintain a hermetic seal even under conditions which would tend to move the electrically conducting pin member.

SUMMARY OF THE INVENTION

The penetrator of the present invention includes a metallic penetrator body which includes an interior aperture having a central longitudinal axis. The interior aperture has a cylindrical portion symmetrical about the axis and flares out to define an enlarged aperture portion, preferably in the form of a cone. An electrically conducting pin member lies substantially along the axis and has a bulbous portion, preferably in the form of a cone, positioned within the conical aperture portion. The cylindrical aperture portion is of a smaller diameter than the cone portion of the pin so that even if the pin is moved, it cannot be forced out of the penetrator body. An encapsulating compound maintains the pin member in position and is preferably a polyamide cured epoxy encapsulating compound containing an inorganic filler in the form of silica which imparts a high compressive strength and which exhibits excellent dielectric properties for the arrangement.

DESCRIPTION OF THE PREFERRED EMBODIMENTS

Figure 1:
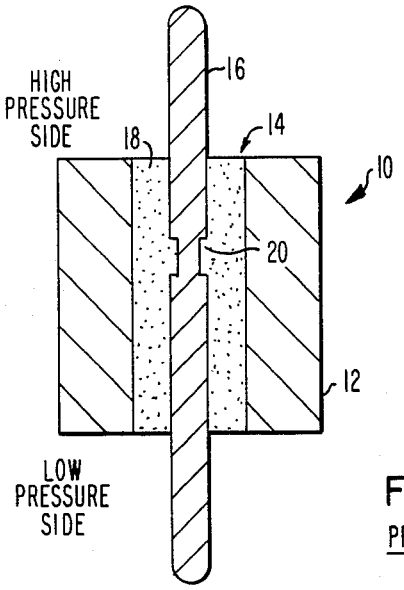
FIG. 1 PRIOR ART
FIG. 1 is a cross-sectional view through a typical electrical penetrator.

FIG. 1 illustrates (in simplified form) a typical prior art penetrator.

The penetrator 10 includes a penetrator body 12 having a central aperture 14 therethrough and into which is positioned an electrically conducting pin member 16. A potting or encapsulating material 18 fills the aperture 14 and maintains the positional orientation of the pin member. A groove 20 machined into the surface of the pin member provides for a better gripping surface.

If the penetrator 10 is placed in a vessel wall across which a differential pressure exists, then one end of the penetrator will be exposed to a high pressure while the other end will be exposed to a relatively lower pressure. One type of encapsulating material 18 commonly utilized in such structure is an epoxy resin which under normal operating conditions for which the penetrator is designed, will withstand the differential pressure and provide for adequate sealing.

Often penetrators must be used in very high differential pressure situations such as may be encountered in deep ocean work where the pressure may be measured in tons per square inch. Under such circumstances, a penetrator such as illustrated in FIG. 1 would place the epoxy encapsulating material under severe shear stress due to the pin structure configuration. A failure of the penetrator at great ocean depths may result in failure to accomplish a specific task, and additionally may result in economic as well as human loss.

Figure 2A:
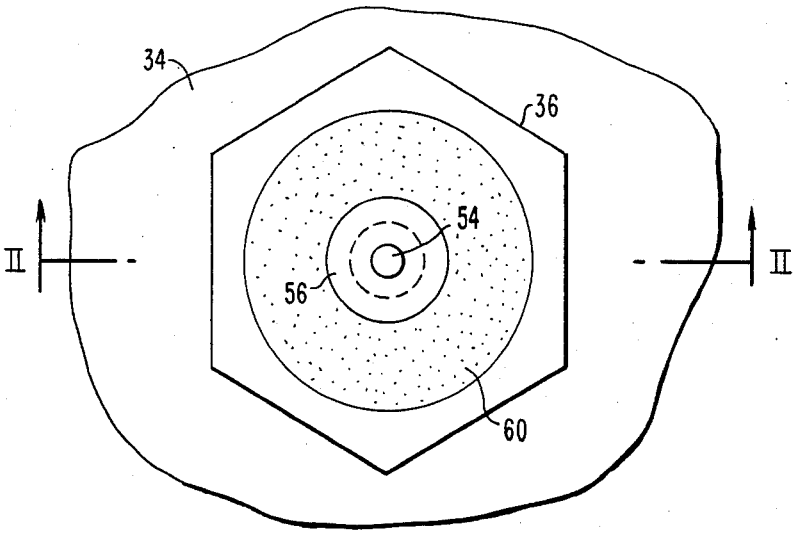
FIG. 2A is a plan view of a penetrator in accordance with one embodiment of the present invention.
Figure 2:
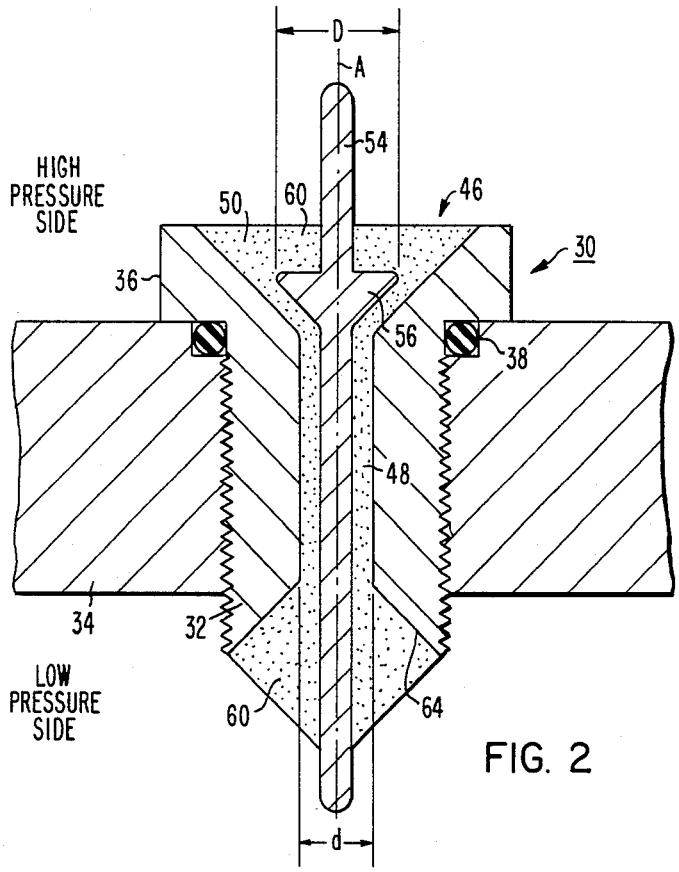
FIG. 2 is a cross-sectional view.

FIG. 2 illustrates, in cross-section, a penetrator in accordance with the present invention which allows operation at extremely high differential pressures, such as may be encountered at deep ocean depths, and will maintain pressure integrity even though a failure may occur.

The penetrator 30 includes a metallic penetrator body 32 illustrated as being threadedly engaged with a wall 34 forming a pressure bulkhead across which a differential pressure exists. The high pressure end of the penetrator body includes a hexagonal head portion 36 (best illustrated in FIG. 2A) to facilitate the insertion of the penetrator. The arrangement includes an O-ring 38 which may be utilized as a water seal.

The penetrator body includes an interior aperture 46 which extends through the body and which has a central longitudinal axis A. The mid portion of the aperture includes a cylindrical portion 48 which is symmetrical about axis A and which flares out at the high pressure end to define an enlarged aperture portion 50 preferably defining a conical surface.

Figure 3:
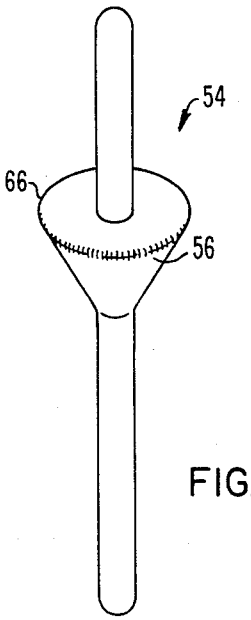
FIG. 3 is a view of the pin member of the penetrator of FIG. 2.

An electrically conducting pin member 54 (also shown in FIG. 3) lies substantially along the axis A and includes a bulbous portion preferably in the general form of a cone 56. An encapsulating compound 60 within the interior aperture 46 maintains the pin member 54 in position, displaced from the interior wall surface of the penetrator body 32. The encapsulating compound is preferably a polyamide cured epoxy encapsulating compound with an inorganic filler such as silica, with the mixture resulting in a material which exhibits low shrinkage in the molding process, high compressive strength, and excellent dielectric properties.

The cylindrical portion 48 of interior aperture 46 has a diameter d whereas the base of cone 56 has a diameter D, where D>d. Under normal operating conditions, the encapsulating compound 60 is compressively loaded, between the cone 56 and the conical surface of aperture portion 50, and if the encapsulating compound should soften due to excessive heat, the dimensions of the pin and aperture are such that the pin cannot be forced through the aperture and thus pressure integrity is maintained.

From an electrical standpoint, the penetrator is designed so as to maintain a substantially constant spacing between the electrically conducting pin and metallic penetrator body within the cylindrical portion 48 of the aperture and between the cone 56 and the conical surface of aperture portion 50. If desired, the dielectric spacing may be increased at the low pressure end of the penetrator with the provision of a tapered end section 64 which is also axisymmetric and defines a conical surface. Additionally, should a failure occur, as previously mentioned, the silica filling would act as an insulator to prevent metal-to-metal contact and a consequent short circuit within the aperture.

With respect to the maintenance of electrical integrity, the cone 56 is preferably fabricated such that its outer surface meets its base in a rounded edge 66, as opposed to a normally sharp transition which would present a charge concentration point and possibly set up an electrical discharge path.

Accordingly, a penetrator has been described which is extremely useful in relatively high differential pressure situations. The encapsulating compound utilized under such differential pressure conditions is placed into a compressive stress as opposed to a shear stress which would be relatively weaker. If the failure of the penetrator does occur, pressure integrity as well as electrical isolation is still maintained. Although FIG. 2 illustrates a single pin in a penetrator body, it is to be understood that a penetrator body may be provided that has a plurality of such interior apertures 46 each accommodating a pin member 54.

We claim:

1. An electrical penetrator comprising:

(a) a metallic penetrator body;

(b) said penetrator body including an interior aperture extending therethrough and having a central longitudinal axis;

(c) said interior aperture including a cylindrical portion symmetrical about said axis and which flares out to define an enlarged aperture portion;

(d) an electrically conducting pin member lying substantially along said axis and having a bulbous portion positioned within said enlarged aperture portion;

(e) said bulbous portion being of such dimension so as to be unable to fit through said cylindrical portion;

(f) an encapsulating compound within said interior aperture to maintain said pin member in position displaced from the wall surface of said interior aperture, said compound comprising an epoxy having an inorganic filler of silica.

2. Apparatus according to claim 1 wherein:

(a) said enlarged aperture portion of said interior aperture defines a conical surface.

3. Apparatus according to claim 1 wherein:

(a) said penetrator body includes just a single said interior aperture and pin member.

4. Apparatus according to claim 1 wherein:

(a) said enlarged aperture portion defines a first conical surface at one end of said penetrator body; and wherein (b) said cylindrical portion flares out to define a second conical surface at the other end of said penetrator body.

5. Apparatus according to claim 1 wherein:

(a) said bulbous portion of said pin member is in the general form of a cone.

6. Apparatus according to claim 5 wherein:

(a) the surface of said cone meets the base thereof in a rounded edge.

7. Apparatus according to claim 1 wherein:

(a) the exterior of said penetrator body has a threaded portion for threaded engagement with a pressure bulkhead.

8. Apparatus according to claim 7 wherein:

(a) one end of said penetrator body defines a nut portion to facilitate threaded engagement of said threaded portion with said bulkhead.

* * * * *